US005915608A

United States Patent [19]

Mao

[11] Patent Number: 5,915,608

[45] Date of Patent: Jun. 29, 1999

[54] SHOULDER STRAP BUFFERING DEVICE OF SHOULDER BAG

[76] Inventor: Chen Shou Mao, 344 Section 1, Chung Shan Road, Tah-Cha Township, Taichung Hsien, Taiwan

[21] Appl. No.: 09/087,676

[22] Filed: Jun. 1, 1998

[51] Int. Cl.[6] ..... A45F 3/14

[52] U.S. Cl. ..... 224/257; 224/258; 224/615; 224/616

[58] Field of Search ..... 224/257, 258, 224/264, 615, 616, 621; 150/107, 110, 108; 24/300

[56] References Cited

U.S. PATENT DOCUMENTS 5,544,795 8/1996 Perrin ..... 224/254

5,695,102 12/1997 Jackson ..... 224/264

*Primary Examiner*—Allan N. Shoap
*Assistant Examiner*—Maerena W. Brevard
*Attorney, Agent, or Firm*—Harrison & Egbert

[57] ABSTRACT

A shoulder strap buffering device includes a seat, two springs, an inner confining member, and a cover. The seat is provided with a receiving slot and a plurality of grooves. The springs are disposed in the grooves of the seat. The inner confining member is located in the receiving slot of the seat such that the springs are urged by the inner confining member. The cover is joined with the seat such that the springs and the inner confining member are shielded and located by the cover. The seat and the inner confining member are provided respectively with an elongated hole for engaging the shoulder strap.

4 Claims, 9 Drawing Sheets

SHOULDER STRAP BUFFERING DEVICE OF SHOULDER BAG

FIELD OF THE INVENTION

The present invention relates generally to a shoulder strap of the shoulder bag, and more particularly to a device for buffering the shoulder strap of the shoulder bag.

BACKGROUND OF THE INVENTION

The conventional shoulder strap of the shoulder bag can often cause sore muscles on the shoulder of a person carrying the shoulder bag, especially when the shoulder bag is fully loaded and when the person is walking fast across the streets.

SUMMARY OF THE INVENTION

The primary objective of the present invention is to provide a shoulder bag with a shoulder strap buffering device capable of lessening the pressure exerted on the shoulder strap.

In keeping with the principle of the present invention, the foregoing objective of the present invention is attained by a shoulder strap buffering device comprising a seat, two springs, an inner confining member, and a cover. The seat is provided with a receiving slot and a plurality of parallel grooves for locating the springs. The inner confining member is disposed in the receiving slot such that one end of the inner confining member urges the common end of the springs. The seat is fastened by the cover. The seat is provided at one end thereof with a hole for engaging the shoulder strap.

The foregoing objective, features and functions of the present invention will be more readily understood upon a thoughtful deliberation of the following detailed description of the present invention with reference to the accompanying drawings.

DETAILED DESCRIPTION OF THE INVENTION

Figure 1:
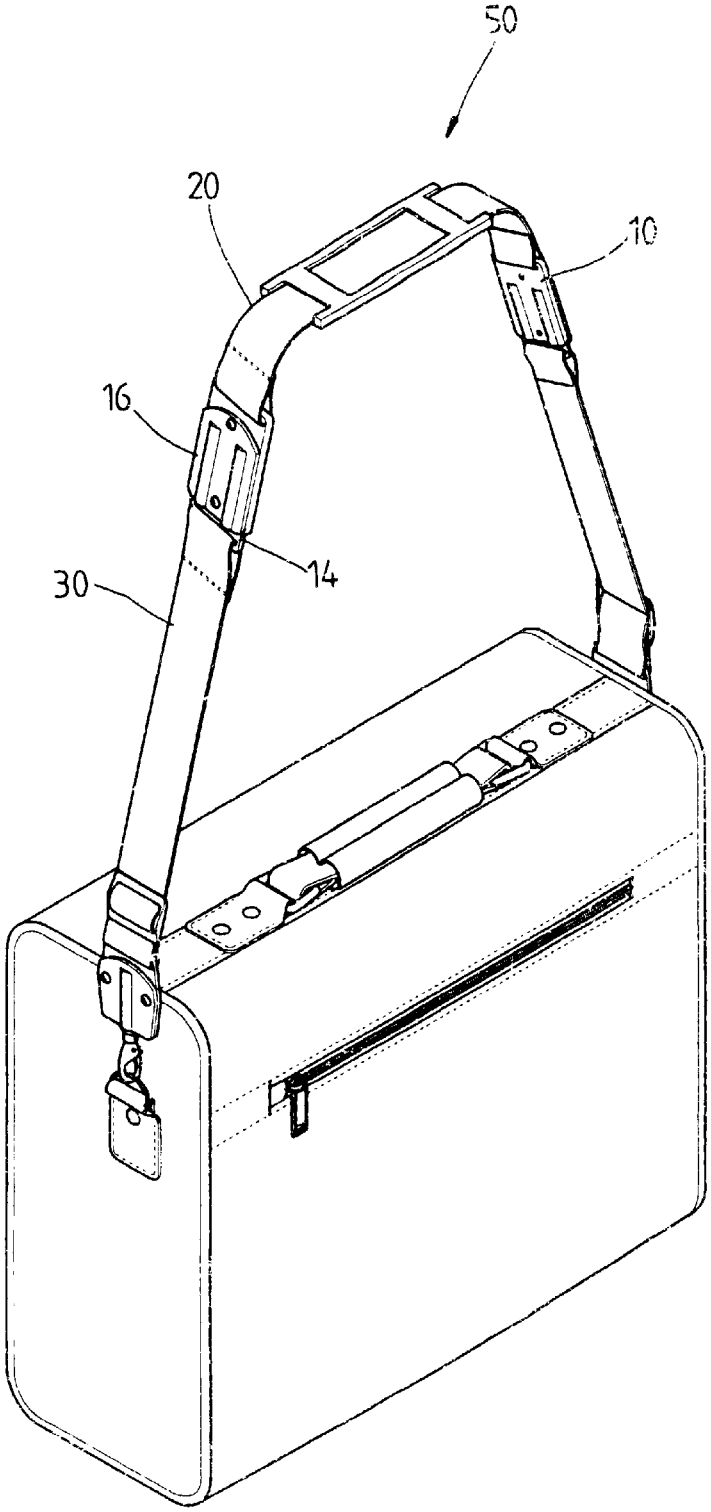
FIG. 1 shows a perspective view of the present invention in conjunction with a shoulder bag.
Figure 2:
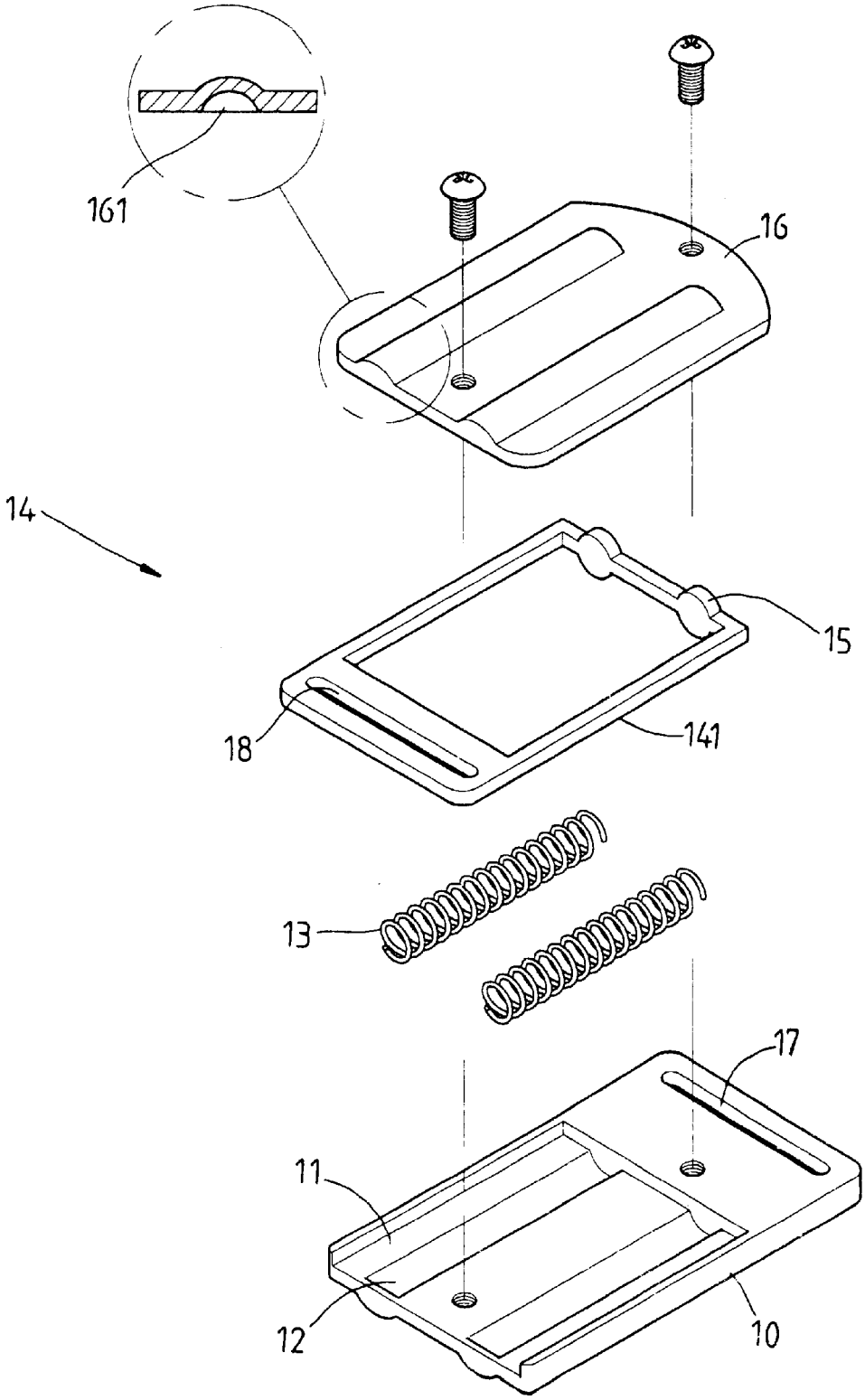
FIG. 2 shows an exploded view of the present invention.
Figure 3:
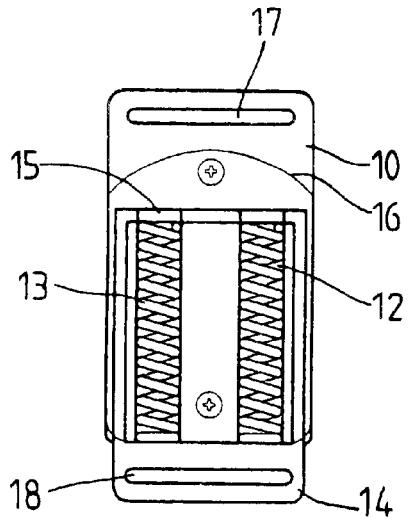
FIG. 3 shows a sectional schematic view of the present invention in combination.

As shown in FIGS. 1, 2, and 3, a shoulder strap buffering device of the present invention is composed of a seat 10, two springs 13, an inner confining member 14, and a cover 16.

The seat 10 is provided with a receiving slot 11, a plurality of parallel grooves 12, and a long hole 17 which is engaged with one end of an upper shoulder strap 20.

The springs 13 are located in the grooves 12.

The inner confining member 14 is disposed in the receiving slot 11 of the seat 10 such that the arresting projections 15 of one end of the inner confining member 14 urge one end of each spring 13, and that another end of the inner confining member 14 is extended outside the seat 10. Another end of the inner confining member 14 is provided with an elongated hole 18 which is engaged with one end of a lower shoulder strap 30.

The cover 16 is fastened to the top of the receiving slot 11 for locating the springs 13 and the inner confining member 14.

The inner confining member 14 is provided with a frame 141 capable of pushing the springs 13. The cover 16 is provided with a long slot 161 for locating the springs 13.

Figure 5:
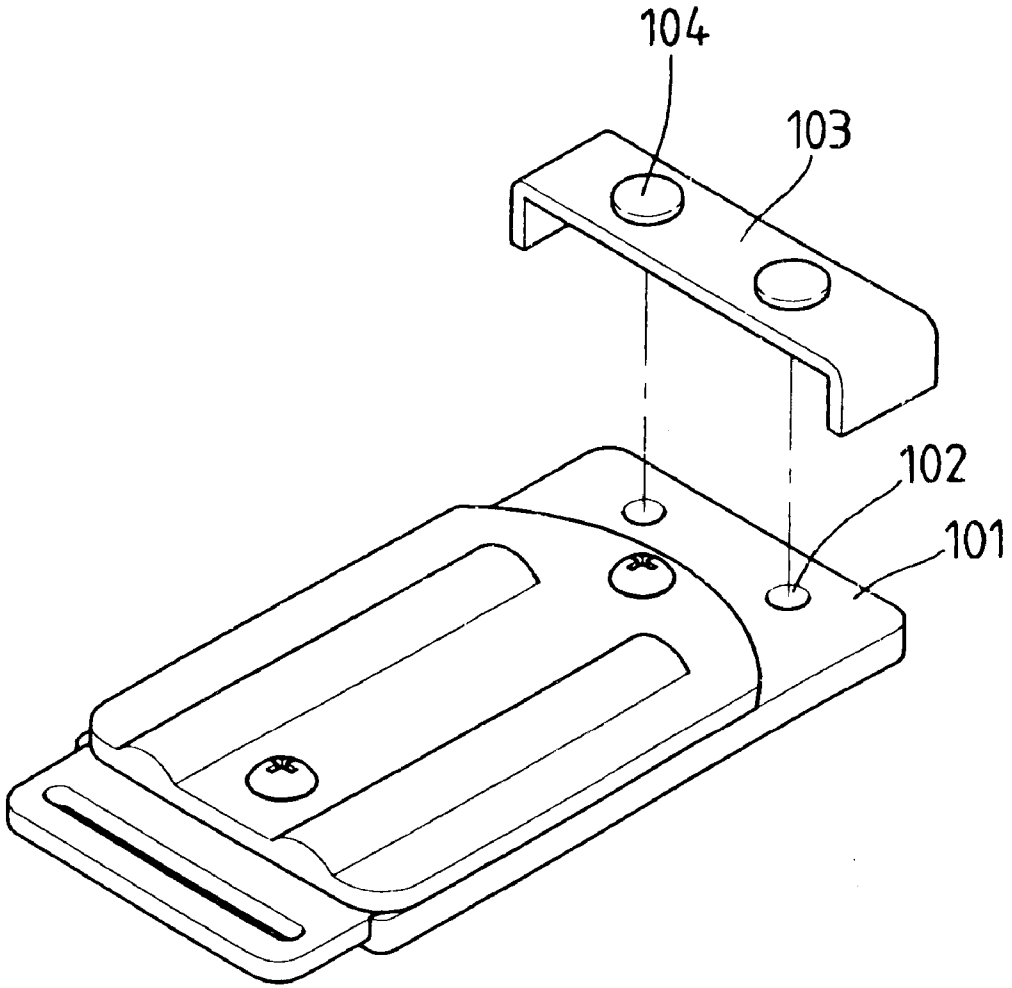
FIG. 5 shows an exploded view of a first preferred embodiment of the present invention.
Figure 6:
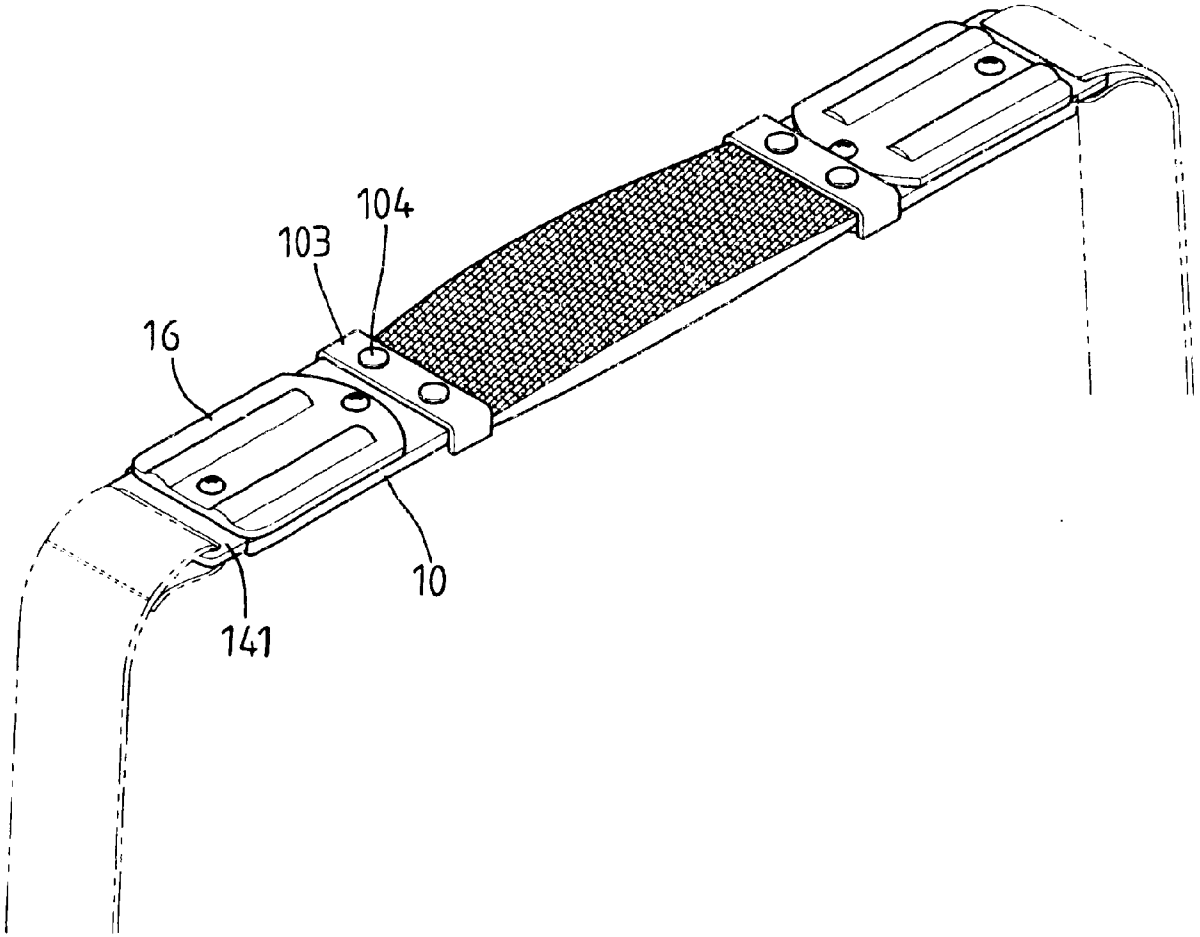
FIG. 6 shows a schematic view of the first preferred embodiment of the present invention.

As shown in FIGS. 5 and 6, the outer end 101 of the seat is provided with a plurality of through holes 102 and an inverted U-shaped member 103 which is engaged with an inverted U-shaped member of the upper shoulder strap 20.

Figure 7:
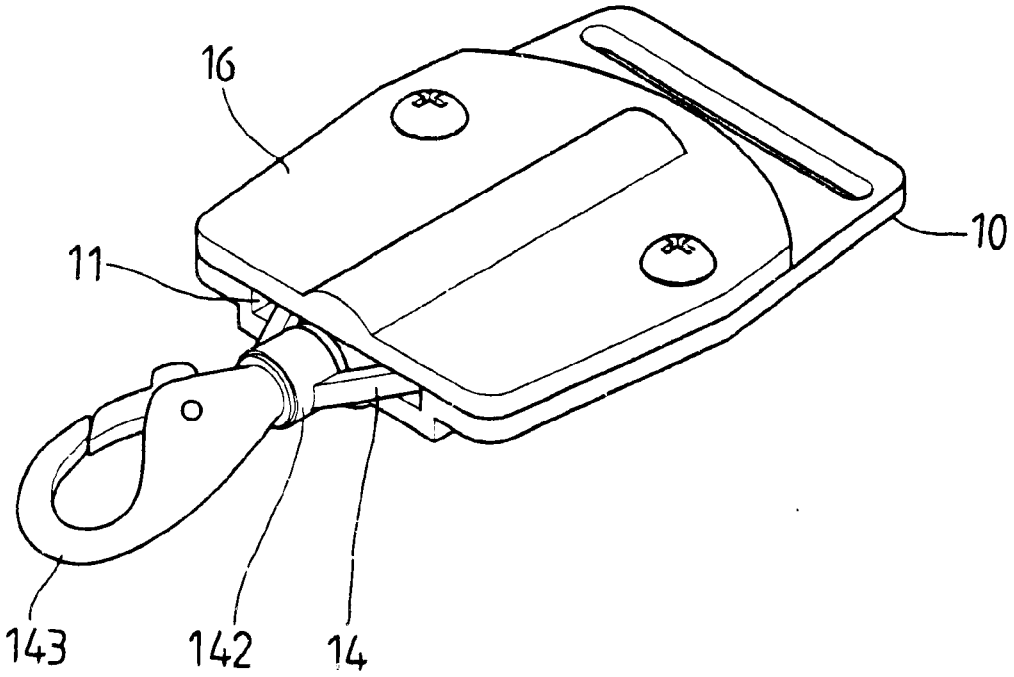
FIG. 7 shows a schematic view of a second preferred embodiment of the present invention.
Figure 8:
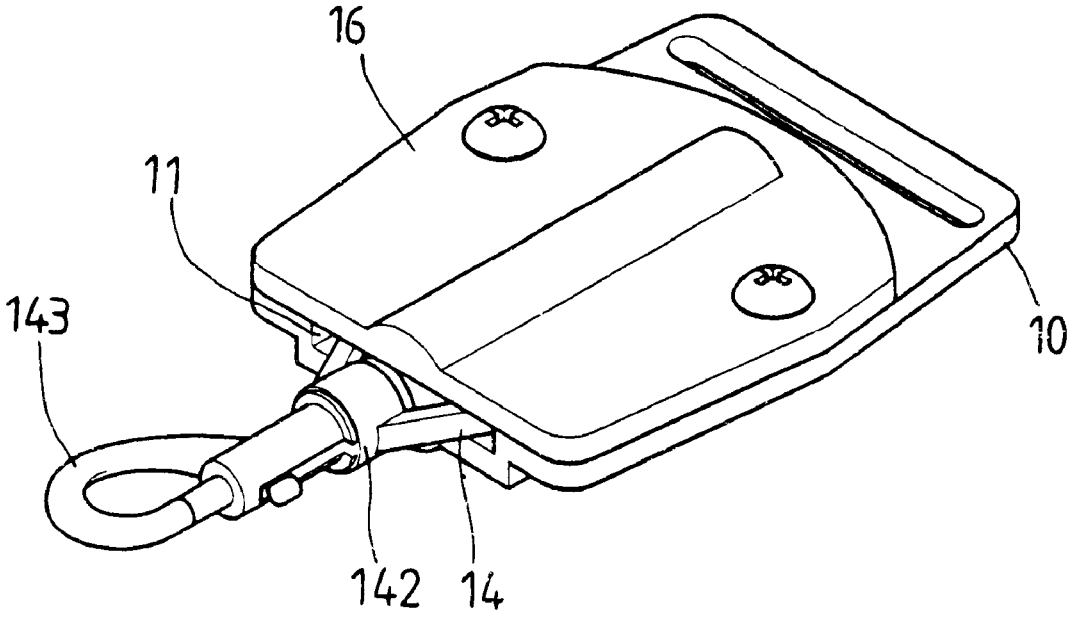
FIG. 8 shows a perspective view of a third preferred embodiment of the present invention.
Figure 9:
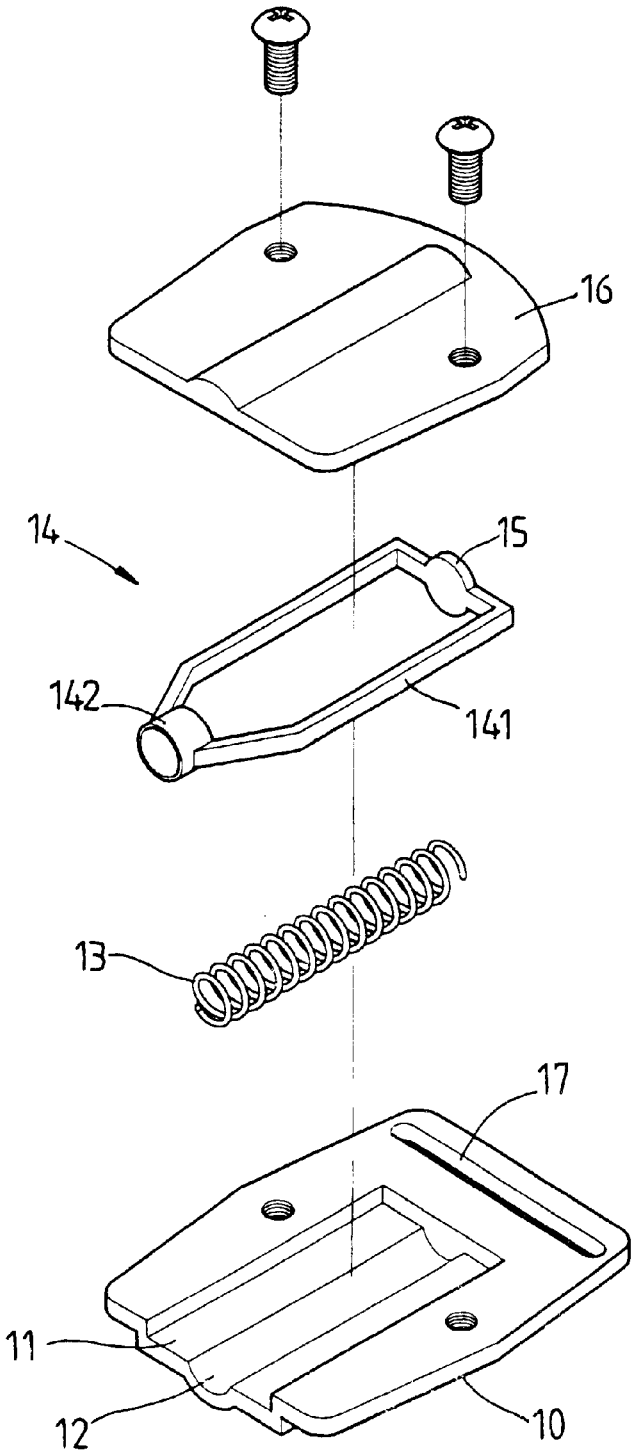
FIG. 9 shows an exploded view of the second preferred embodiment of the present invention.
Figure 10:
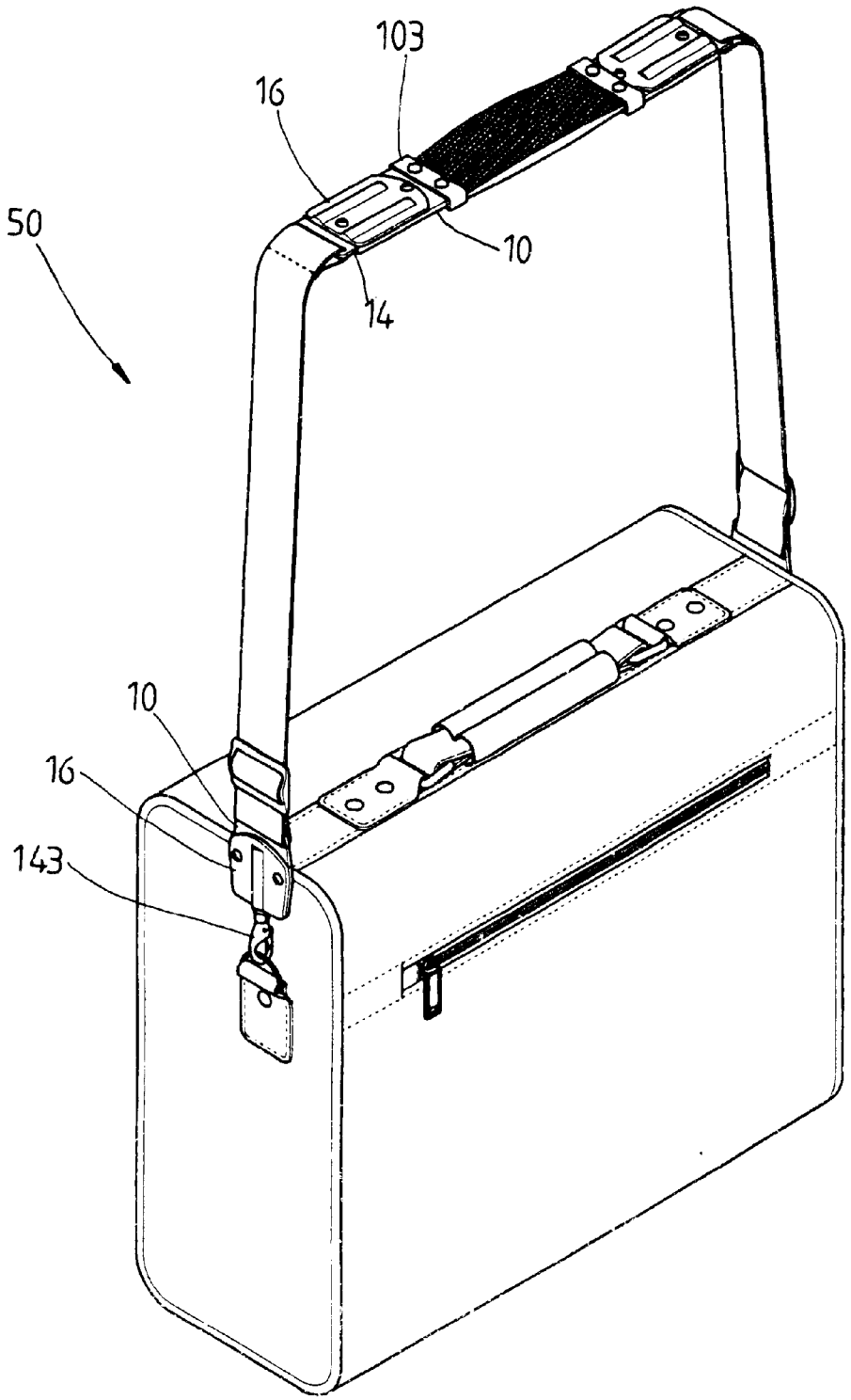
FIG. 10 shows a schematic view of the first and the second preferred embodiments of the present invention.

As shown in FIGS. 7, 8, and 9, the inner confining member 14 is provided with a hollow columnar body 142 for fastening a hooked body 143.

Figure 4:
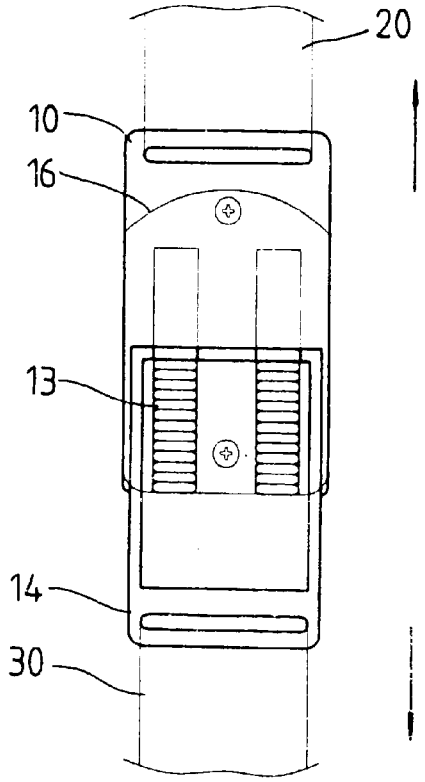
FIG. 4 shows a schematic view of the present invention in operation.

As shown in FIGS. 1, 3, and 4, the present invention is fastened with the junctions of two ends of the upper shoulder strap 20 and two lower shoulder straps 30. As the shoulder strap 50 is exerted on by the pressure of the shoulder bag, the inner confining member 14 is pulled by the lower shoulder strap 30 to compress the springs 13. In the meantime, the seat 10 is located by the upper shoulder strap 20. The buffering effect is attained by the springs 13.

As shown in FIGS. 7, 8, 9, and 10, the hooked body 143 of the inner confining member 14 is used to retain a heavy object.

I claim:

1. A shoulder strap buffering device of a shoulder bag, the shoulder strap buffering device comprising:

a seat provided with a receiving slot, a plurality of parallel grooves, and an elongated hole;

two springs disposed in said grooves of said seat;

an inner confining member provided at one end thereof with a plurality of arresting projections and located in said receiving slot of said seat such that said springs are urged by said arresting projections, and that another end of said inner confining member is extended outside said seat, said another end of said inner confining member provided with an elongated hole; and a cover fastened with said seat for locating said springs and said inner confining member, and means provided for attaching to a shoulder strap.

2. The device as defined in claim 1, wherein said inner confining member is provided with a frame capable of compressing said springs.

3. The device as defined in claim 1, wherein said cover is provided with an elongated slot for locating said springs.

4. The device as defined in claim 1, wherein said inner confining member is provided at one end thereof with a hollow columnar body for fastening a hooked body.

* * * * *